US006744412B1

(12) United States Patent
Lopez

(10) Patent No.: US 6,744,412 B1
(45) Date of Patent: Jun. 1, 2004

(54) HIGH UP/DOWN RATIO GPS ANTENNAS WITH SERRATED ABSORBER

(75) Inventor: Alfred R. Lopez, Commack, NY (US)

(73) Assignee: BAE Systems Information and Electronic Systems Integration Inc., Greenlawn, NY (US)

( * ) Notice: Subject to any disclaimer, the term of this patent is extended or adjusted under 35 U.S.C. 154(b) by 0 days.

(21) Appl. No.: 10/282,384

(22) Filed: Oct. 29, 2002

(51) Int. Cl.[7] ..... H01Q 21/20; H01Q 21/28; H01Q 1/12

(52) U.S. Cl. ..... 343/799; 343/853; 343/891

(58) Field of Search ..... 343/793, 799, 343/841, 789, 853, 820, 803, 810, 814, 891, 797, 796

(56) References Cited

U.S. PATENT DOCUMENTS 4,649,391 A * 3/1987 Tsuda et al. ..... 342/153
5,264,862 A * 11/1993 Kumpfbeck ..... 343/853
5,534,882 A * 7/1996 Lopez ..... 343/891
6,201,510 B1 * 3/2001 Lopez et al. ..... 343/799
6,498,589 B1 * 12/2002 Horii ..... 343/727

* cited by examiner

*Primary Examiner*—James Clinger
*Assistant Examiner*—Chuc Tran
(74) *Attorney, Agent, or Firm*—Kenneth P. Robinson

(57) ABSTRACT

To provide horizon to zenith reception coverage for Differential GPS operations, two antennas with complementary patterns may be used. An antenna for high-angle coverage includes a ring of four dipoles excited to provide progressive-phase-omnidirectional (PPO) coverage. A cylindrical (e.g., octagonal) structure, with an upper edge at the diode horizontal centerline, extends upward from a ground plane section. An absorber configuration having a serrated upper edge portion extends around the dipoles above the cylindrical structure and has radiation absorption properties. For an octagonal configuration, the absorber configuration may include eight resistance card sections with triangular portions extending above the wall structure. A conical antenna pattern expanding upwardly can provide omnidirectional coverage above a selected elevation angle (e.g., above 55° elevation).

20 Claims, 4 Drawing Sheets

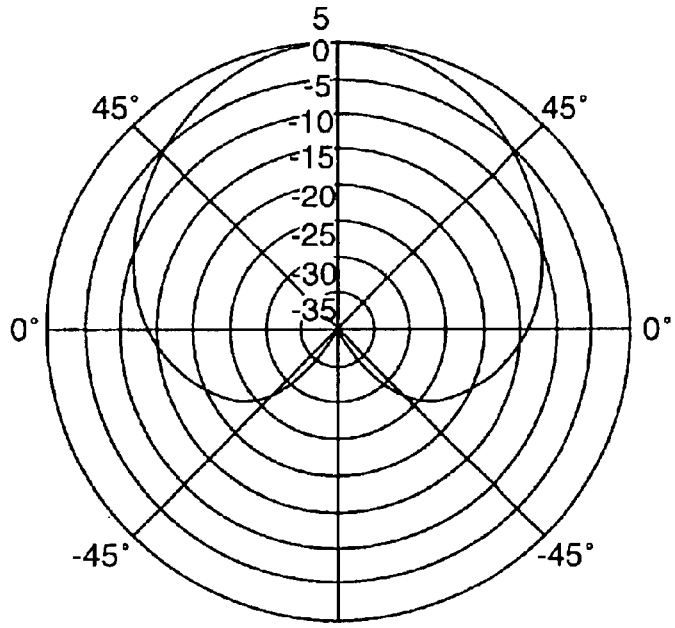
FIG. 6 GAIN (dBiRC)
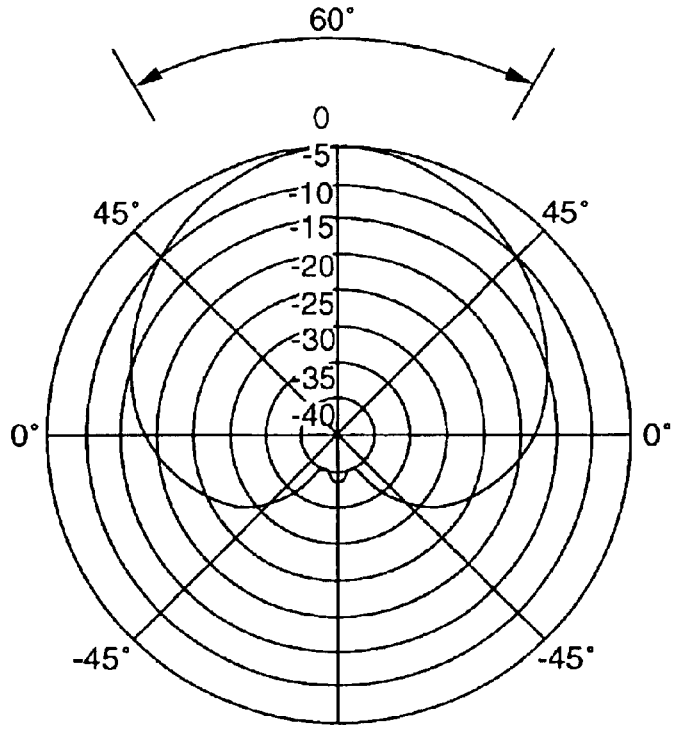
FIG. 7 POWER RELATIVE TO PEAK POWER (dB)

HIGH UP/DOWN RATIO GPS ANTENNAS WITH SERRATED ABSORBER

RELATED APPLICATIONS (Not Applicable)

FEDERALLY SPONSORED RESEARCH (Not Applicable)

BACKGROUND OF THE INVENTION

This invention relates to antennas to receive signals from Global Positioning System (GPS) satellites and, more specifically to antennas arranged for high-angle reception for differential GPS applications.

Antenna systems providing a circular polarization characteristic in all directions horizontally and upward from the horizon, with a sharp cut-off characteristic below the horizon are described in U.S. Pat. No. 5,534,882, issued to A. R. Lopez on Jul. 9, 1996. Antennas having such characteristics are particularly suited to reception of signals from GPS satellites.

As described in that patent, application of the GPS for aircraft precision approach and landing guidance is subject to various local and other errors limiting accuracy. Implementation of Differential GPS (DGPS) can provide local corrections to improve accuracy at one or more airports in a localized geographical area. A DGPS ground installation provides corrections for errors, such as ionospheric, tropospheric and satellite clock and ephemeris errors, effective for local use. The ground station may use one or more GPS reception antennas having suitable antenna pattern characteristics. Of particular significance is the desirability of antennas having the characteristic of a unitary phase center of accurately determined position, to permit precision determinations of phase of received signals and avoid introduction of phase discrepancies. Antenna systems having the desired characteristics are described and illustrated in U.S. Pat. No. 5,534,882, which is hereby incorporated herein by reference.

For such applications, antennas utilizing a stack of individually-excited progressive-phase-omnidirectional elements are described in U.S. Pat. No. 6,201,510, issued to A. R. Lopez, R. J. Kumpfbeck and E. M. Newman on Mar. 13, 2001. Elements as described therein include self-contained four-dipole elements which are employed in stacked configuration to provide omnidirectional coverage from the zenith (90° elevation) to the horizon (o°) or from a high elevation angle to the horizon, with a sharp pattern cut off below the horizon. U.S. Pat. No. 6,201,510 is hereby incorporated herein by reference.

In some applications, it may be desirable to employ a set of two antennas, each providing omnidirectional coverage (in azimuth) and the antennas providing complementary coverage in elevation. For example, an antenna pursuant to U.S. Pat. No. 6,201,510 may be designed to provide omnidirectional coverage from the horizon to 55° elevation. If available, a second high-angle omnidirectional antenna of appropriate design and performance could be used to provide complementary elevation coverage from 55° elevation to the zenith. Used together, such antennas would provide horizon to zenith coverage for omnidirectional reception of GPS signals for DGPS applications. Available antennas (for example, conventional choke-ring antennas as discussed below) have been subject to limitations in areas such as performance, size, cost or reliability.

Objects of the present invention are to provide new and improved antennas, including antennas usable for high-angle reception for DGPS applications and antennas having one or more of the following characteristics and advantages:

- omnidirectional coverage from a selected elevation angle to zenith;
- high-angle elevation coverage usable in combination with an antenna providing lower elevation coverage;
- progressive-phase-omnidirectional radiation pattern;
- inclusion of an energy absorber configuration around a plurality of radiating elements to determine lower elevation radiation characteristics;
- inclusion of a combination of a cylindrical reflective structure and a cylindrical energy absorber configuration;
- inclusion of a serrated-edge cylindrical energy absorber; and
- inclusion of an energy absorber utilizing material having radiation absorption properties.

SUMMARY OF THE INVENTION

In accordance with the invention, an antenna, having a progressive-phase-omnidirectional excitation network and an absorber configuration, includes first, second, third and fourth dipoles successively spaced around a vertical axis and a signal port. A progressive-phase-omnidirectional (PPO) excitation network, coupled between the signal port and the four dipoles, includes (a) a first quadrature coupler coupled to the signal port and coupled between the first and second dipoles to provide first dipole excitation of a first phase and to provide second dipole excitation of a quadrature phase, and (b) a second quadrature coupler coupled to the signal port and coupled between the third and fourth dipoles to provide third dipole excitation of a phase differing by 180 degrees from the first phase and to provide fourth dipole excitation of a quadrature phase relative to the third dipole.

The antenna includes a ground plane section with a reflective surface positioned below the four dipoles, a cylindrical structure coupled to the ground plane section, having a reflective surface, and extending around the four dipoles, and an absorber configuration having a serrated upper-edge portion extending around the four dipoles above the cylindrical structure and having radiation absorption properties.

Also in accordance with the invention, an antenna, with reduced low-angle reception, includes a plurality of antenna elements positioned around a vertical axis and arranged to provide an omnidirectional antenna pattern, a ground plane section with a reflective surface positioned below the antenna elements, a cylindrical structure extending above the ground plane section, having a reflective surface, and extending around the antenna elements, and an absorber configuration extending around the antenna elements above the cylindrical structure and having radiation absorption properties.

For a better understanding of the invention, together with other and further objects, reference is made to the accompanying drawings and the scope of the invention will be pointed out in the accompanying claims.

BRIEF DESCRIPTION OF THE DRAWINGS

FIG. 6 is an elevation radiation plot of gain v. elevation angle.

FIG. 7 is an elevation radiation plot of power level relative to peak power v. elevation angle, showing an up/down ratio exceeding 30 dB for a 60° inverted conical pattern.

DESCRIPTION OF THE INVENTION

Figure 1:
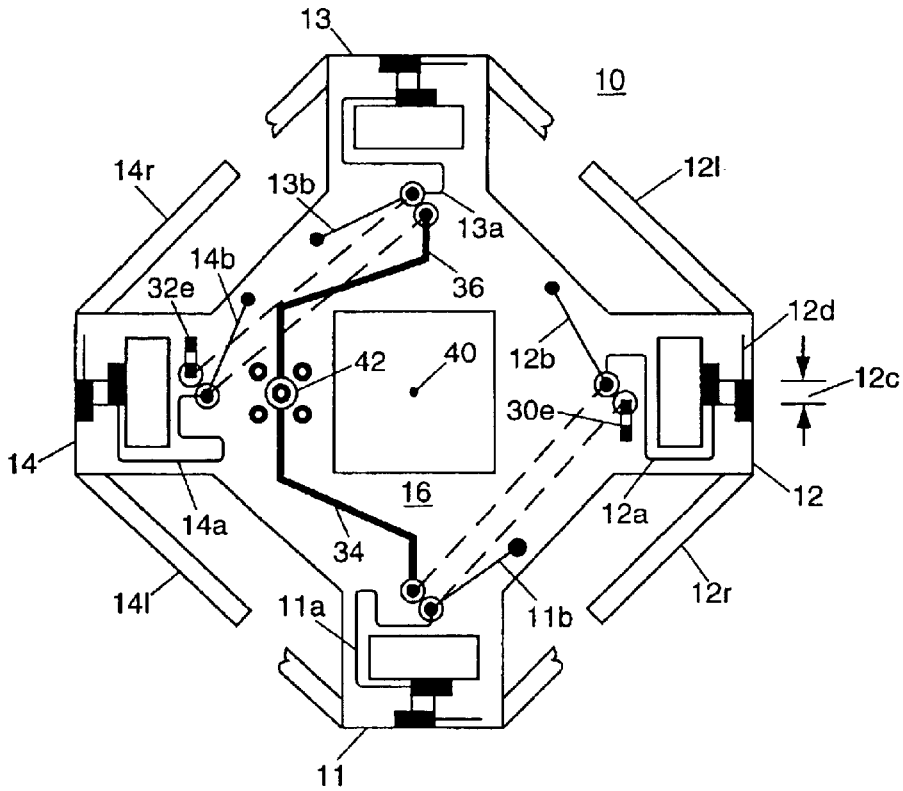
FIG. 1 PRIOR ART
FIG. 1 is a top view of a four-dipole configuration usable in antennas pursuant to the invention.
Figure 2:
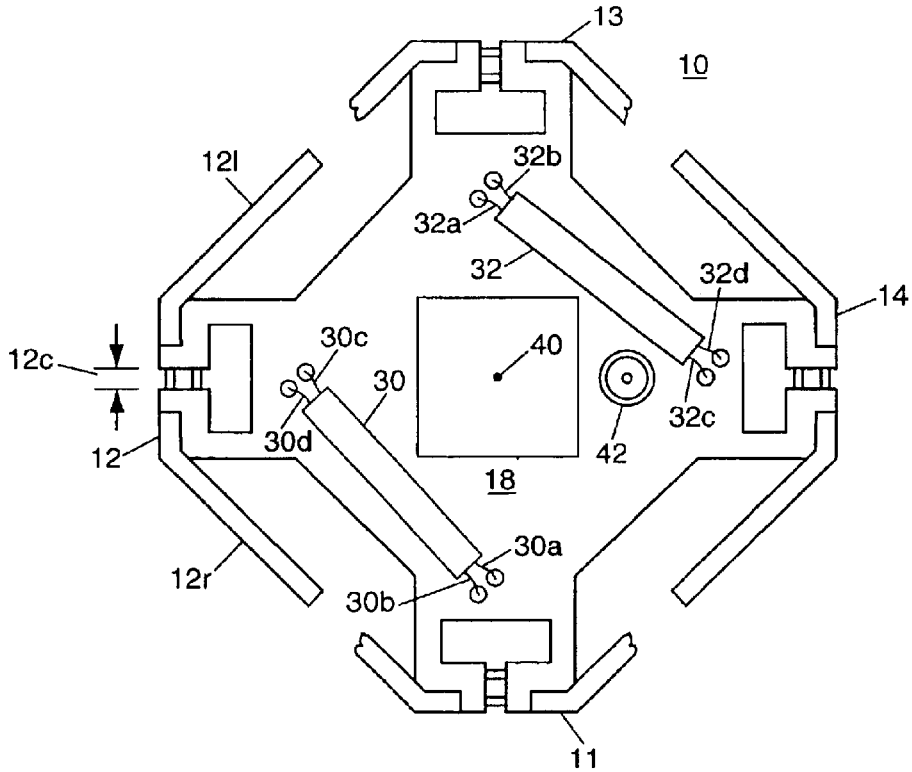
FIG. 2 PRIOR ART
FIG. 2 is a bottom view of the FIG. 1 four-dipole configuration.
Figure 3:
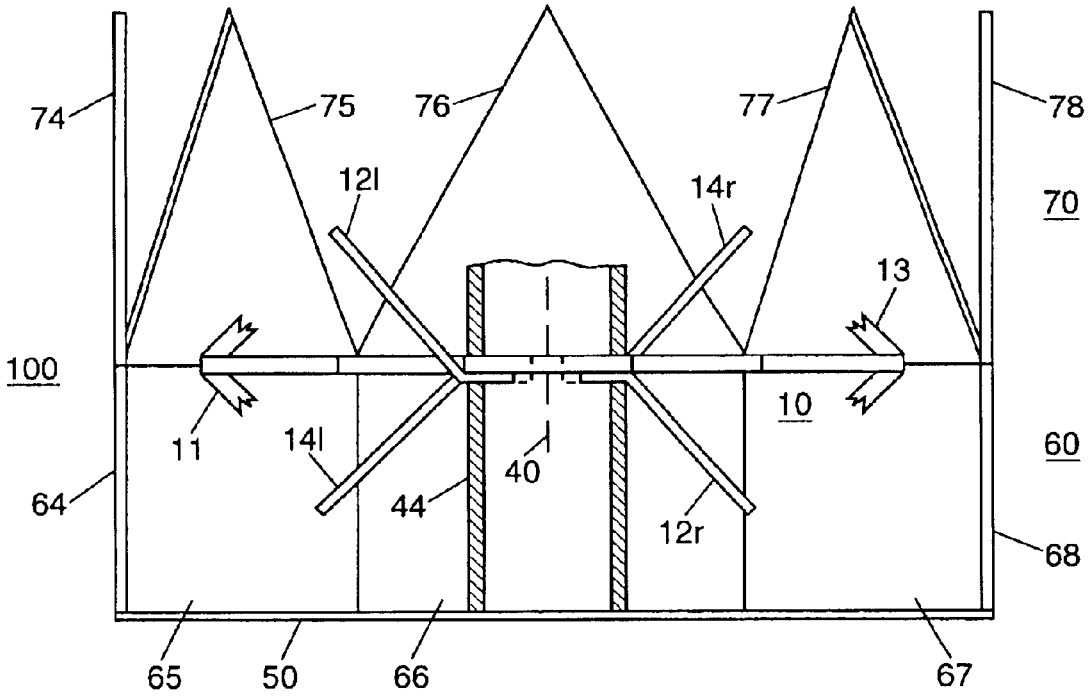
FIG. 3 is a side view (with selected side portions removed) of an antenna pursuant to the invention, which utilizes the four-dipole configuration of FIG. 1.
Figure 4:
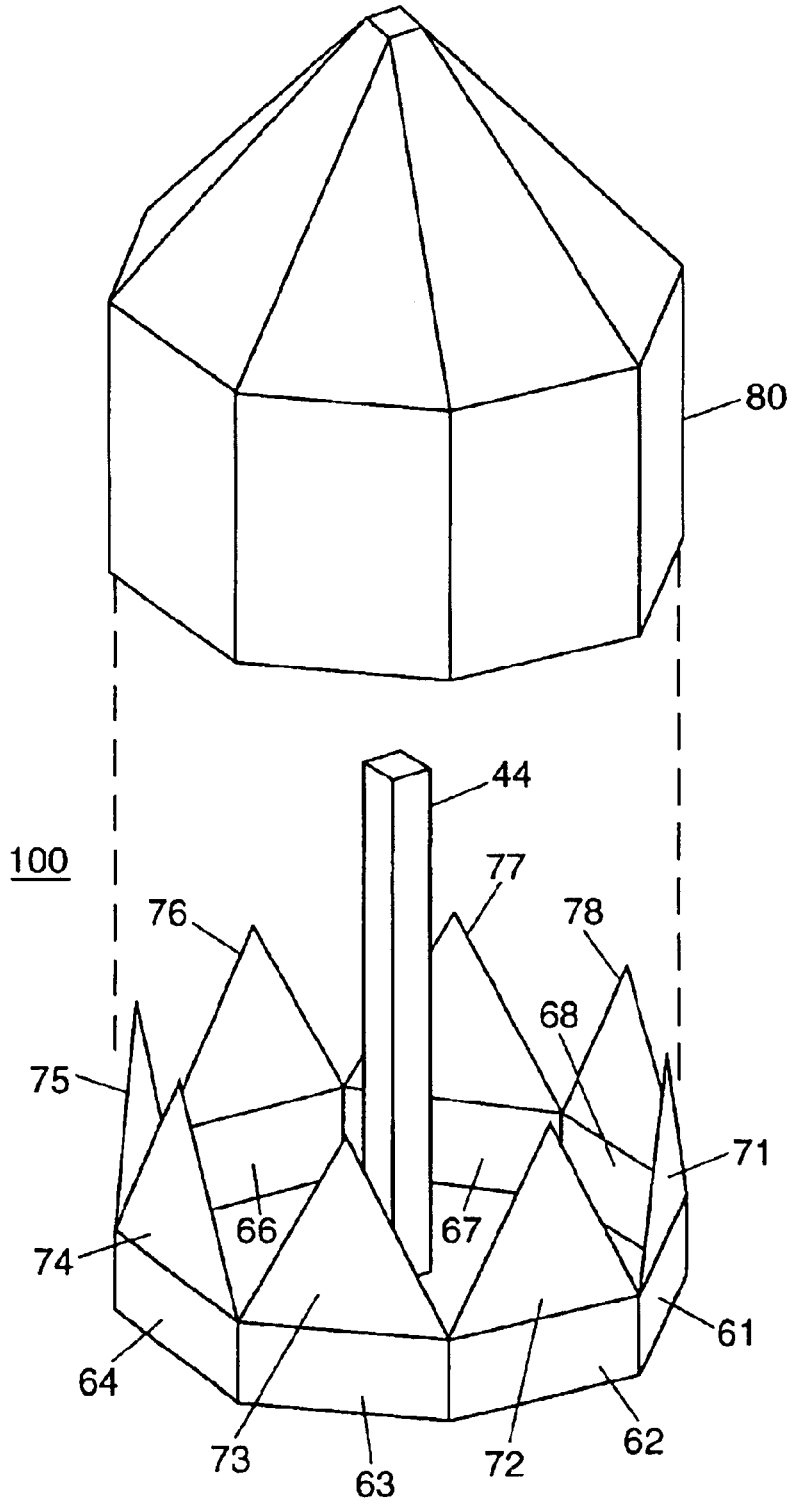
FIG. 4 is a simplified orthogonal view of the FIG. 3 antenna with the four-dipole configuration not shown and additionally including an octagonal conical type radome in raised position.

FIGS. 1 and 2 are respective top and bottom views of a four-dipole configuration usable in a GPS antenna for high-angle reception for DGPS applications, pursuant to the invention. FIG. 3 is a side view of a complete antenna, including the four-dipole configuration, for such use. In FIG. 3, certain side portions of a reflective cylindrical structure 60 and an absorber configuration 70 are removed to provide internal visibility. FIG. 4 is a simplified orthogonal view showing all such side portions, plus a radome in raised position.

FIG. 1 shows a four-dipole configuration 10 including first, second, third and fourth dipoles 11, 12, 13, 14, respectively. Each dipole includes two opposed arms. The ends of the arms of dipoles 11 and 13, which would overlap arms of adjacent dipoles in this view, have been partially removed for clarity of illustration. In actual use, all four dipoles would typically be of substantially identical construction. This four-dipole configuration is shown and described in U.S. Pat. No. 6,201,510.

FIG. 1 illustrates an implementation using printed circuit techniques. In FIG. 1, conductor configurations are supported on the top surface of an insulative layer or substrate 16. The bottom view of FIG. 2, shows the bottom surface of a conductive (e.g., copper) layer 18 adhered to substrate 16. In this embodiment, individual arms of the dipoles (e.g., arms 12*l* and 12*r* of second dipole 12) are separately fabricated and soldered or otherwise attached at appropriate positions to the conductive layer 18. At particular locations, circuit connections pass through openings in conductive layer 18 and substrate 16 to circuit portions above. At other locations circuit connections pass through substrate 16 from above to make conductive contact with layer 18, which represents ground potential. Configuration 10 includes a square central cutout suitable to receive a square conductive member and other cutouts to be described.

As shown in the FIG. 3 side view of the FIG. 1 four-dipole configuration, opposed arms 12*l* and 12*r* of dipole 12 extend respectively upward and downward at approximately 45° diagonally to horizontal. Arms 14*l* and 14*r* of dipole 14, at the back of configuration 10 in the view of FIG. 3, are also visible. The four dipoles 11, 12, 13, 14 are successively spaced around a vertical axis 40, shown dashed in FIG. 3 and in end view in FIGS. 1 and 2. Dipole arms are labeled l and r, representing the left arm and right arm of a particular dipole when viewed from vertical axis 40 (i.e., viewed from a position above the top surface of element 10, looking outward from axis 40).

Four-dipole configuration 10 includes a signal port illustrated as coaxial connector 42. Connector 42 is shown in FIGS. 2 and 3 with its outer conductor portion mounted to conductive layer 18 and its center conductor passing through layer 18 to the upper surface of substrate 16.

Configuration 10 also includes a progressive-phase-omnidirectional (PPO) excitation network coupled between port 42 and dipoles 11, 12, 13, 14. As illustrated, the PPO network includes first and second quadrature couplers 30 and 32, respectively, as shown in FIG. 2 and first and second transmission line sections 34 and 36, respectively, as shown in FIG. 1. Couplers 30 and 32 in this embodiment are wireline quadrature couplers having an external encasement which is soldered or otherwise grounded to conductive layer 18. Each wireline device is a 3 dB coupler having four signal port conductors: input port "a"; output port "b" providing signals of the same phase as input signals; output port "c" providing signals of quadrature phase (i.e., 90 degree phase lag relative to input signals); and port "d" which is resistively terminated (e.g., 50 ohms to ground). While signal input terminology is used for convenience, it will be understood that the couplers operate reciprocally for the present signal reception application.

Considering both the bottom view of FIG. 2 and the top view of FIG. 1, it will be seen that port a conductor 30*a* of wireline coupler 30 is coupled through layers 18/16 and coupled to signal port 42 via line section 34. Port b conductor 30*b* is coupled through layers 18/16 and coupled to the left arm of first dipole 11, via conductor 11*a*, to provide first dipole excitation of a first phase. Conductor 11*a* and associated shorted stub 11*b* (connected to layer 18 through layer 16) are appropriately dimensioned to provide suitable impedance matching to the dipole using known design techniques. Similarly, port c conductor 30*c* is coupled to the left arm of second dipole 12 via conductor 12*a* to provide second dipole excitation of a quadrature phase (i.e., differing by 90 degrees). Port d conductor 30*d* passes through layers 18/16 and is terminated by a 50 ohm chip resistor 30*e* mounted on the surface of layer 16 and grounded to layer 18.

Second wireline quadrature coupler 32 is correspondingly coupled to third and fourth dipoles 13 and 14, however, in this case couplings are to the right arms of dipoles 13 and 14 (rather than to the left arms, as above). Thus, port a conductor 32*a* of coupler 32 is coupled to signal port 42 via second transmission line section 36. Port b conductor 32*b* (zero phase) is coupled to the right arm of third dipole 13, via conductor 13*a*, with the phase reversal from opposite-arm excitation (i.e., via right arm v. left arm above) resulting in third dipole excitation of a phase opposite (i.e., differing by 180 degrees) to the first phase excitation of first dipole 11 (e.g., 180 degrees lag). Port c conductor 32*c* (quadrature phase) is coupled to the right arm of fourth dipole 14, via conductor 14*a*, with the quadrature phase and phase reversal from opposite arm excitation resulting in fourth dipole excitation of a phase opposite to the second phase excitation of second dipole 12 (e.g., 180 degrees lag). Port d conductor 32*d* is resistively terminated via chip resistor 32*e*. Shorted stubs 12*b*, 13*b*, and 14*b* as shown are provided for dipoles 12, 13 and 14 as discussed above with reference to stub 11*b*.

During signal reception, this configuration is effective to provide at signal port 42 a signal representative of reception via a 360 degree PPO azimuth antenna pattern. Thus, the PPO network is effective to provide relative signal phasing of zero, −90, −180 and −270 degrees at first, second, third and fourth dipoles 11, 12, 13, 14, respectively, with received signals combined to provide the PPO signal at port 42. The four-dipole configuration 10 thus operates as a self-contained unit to provide this PPO capability.

For effective GPS operation, the four-dipole configuration of FIGS. 1–3 is double tuned for operation at the two GPS frequencies of 1,572.42 MHZ and 1,227.6 MHZ. With reference to second dipole 12, double tuning is provided by a tuned circuit utilizing the inductance of a stub comprising gap 12*c* backed up by a rectangular opening in conductive layer 18, in combination with capacitive stub 12*d* connected to layer 18 and overlying a portion of dipole 12. Provision of this tuned circuit enables the dipole to be double tuned using known design techniques, to enable reception at both GPS signal frequencies.

In a presently preferred embodiment, four-dipole configuration 10 is fabricated as a self-contained unit using printed circuit techniques, with the dipole arms, wireline quadrature couplers and coaxial connector soldered in place. For GPS application, the configuration 10 has dimensions of approximately three and a quarter inches across and an inch and a quarter in height. The configuration is shown slightly enlarged and some dimensions may be distorted for clarity of presentation. The square central opening is dimensioned for placement on a square conductive member 44 of hollow construction (e.g., a square aluminum pipe shown sectioned in FIG. 3) with electrical connection of ground layer 18 to the member 44. The inclusion of member 44 is optional in so far as basic operation of the antenna is concerned and it may be included and arranged to provide the function of a lightning rod in field installations of the antenna.

Referring now more particularly to FIGS. 3 and 4, FIG. 4 provides a view of the structure in which the four-dipole configuration 10 is positioned as shown in FIG. 3. For purposes of clarity of illustration, the four-dipole configuration 10 is not shown in FIG. 4. In FIG. 3 portions 61, 62 and 63 of cylindrical structure 60 and portions 71, 72 and 73 of absorber configuration 70 are removed to show internal details of the antenna 100.

As shown in FIGS. 3 and 4, the octagonal structure of antenna 100 includes a ground plane section 50, a cylindrical structure 60 including eight portions 61, 62, 63, 64, 65, 66, 67 and 68 in this octagonal embodiment, and an absorber configuration 70 including eight portions 71, 72, 73, 74, 75, 76, 77 and 78, each extending above a respective wall portion. Radome 80, shown raised above the main portion of the antenna, may be constructed of any suitable radiation-transmissive material and dimensioned to cover and protect the electrical portions from atmospheric conditions. To provide the described lightning rod function, a square metallic member 40 may extend to the top of the radome.

In the side view of FIG. 3, with portions 61, 62 and 63 of the cylindrical structure and absorber portions 71, 72 and 73 removed, ground plane structure 50, portions 64 and 68 and absorber portions 74 and 78 are seen in edge profile. Ground plane structure 50 may be formed of a hexagonal piece of sheet metal or other material or composite having a reflective surface (typically the upper surface) to function as a ground plane. The cylindrical structure 60, in this embodiment having the form of a hollow cylinder of octagonal cross section, may similarly be formed of sheet metal or other material or composite having a reflective surface (typically the inner surface).

In FIGS. 3 and 4, the absorber configuration 70 comprises material having radiation absorptive properties. Thus, the absorber configuration (portions 74–78 shown in FIG. 3) may be formed of thin resistance card stock having a resistance characteristic of 100 Ohms per square, for example. In this embodiment the absorber configuration is provided with a serrated upper edge region by providing eight identical or similar portions 71–78 of resistance card stock, each of which has a form of an equilateral triangle to the extent that such portions extend above the upper edge of the cylindrical structure 60. Absorber portions 74–78 in FIG. 3 may each be attached to and supported by a respective one of the portions 64–68. Suitable attachment arrangements may be provided by skilled persons as appropriate in each particular application of the invention. Thus, for example, each of the absorber portions 71–78 of FIG. 4 may have a lower portion extending below the upper edge of the respective portions 61–68 of the cylindrical structure and may be suitably adhered to or otherwise supported contiguous to the outer surface of the respective portions 61–68. In other applications it may be desirable to fix the absorber portions to the top edges of the portions 61–68 or to provide absorber portions which extend downward contiguous to the inner surfaces of the portions 61–68 and are suitably adhered or otherwise supported.

Figure 5:
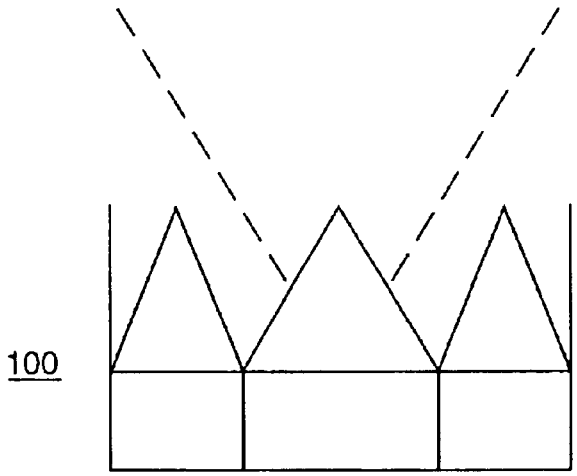
FIG. 5 is a simplified side view of the antenna of FIGS. 3 and 4, with representation of a 60° conical antenna pattern extending upward.

Pursuant to the invention, the illustrated combination of the four-dipole configuration 10, ground plane section 50, cylindrical structure 60 and absorber configuration 70 of FIG. 3 are arranged to increase or maximize the up/down ratio (e.g., in an inverse cone region centered on the zenith direction and expanding upwardly) so as to provide high-elevation coverage with reduced radiation/reception below a selected elevation angle and minimum radiation in the nadir direction. This is illustrated in FIG. 5, which is a simplified view of the antenna of FIG. 4, without conductive member 44. As represented in FIG. 5, the antenna radiation/reception pattern is configured as an inverse cone having a half-power transition region at a selected elevation angle, which may be 60° as shown, for a currently preferred embodiment. In such embodiment, DGPS operations may utilize a combination of a low-angle antenna (e.g., an appropriately configured antenna pursuant to U.S. Pat. No. 6,201,510) and a high-angle antenna pursuant to the present invention, with the antennas thus providing complementary patterns with combined low-angle and high-angle coverage with a 55° elevation crossover angle. Choices of crossover angles and antenna selections are design considerations subject to determination by skilled persons in specific applications As indicated, the absorber configuration 70, which may comprise resistance card portions with triangular shaping as shown, reduces radiation in the nadir direction. The resistance card portions convert straight edge diffraction from the upper edge of the cylindrical structure 60 to vertex diffraction. With this configuration, the distance between the upper and lower vertices of the serrated edge formed by the arrangement of the resistance card portions 71–78 and the resistance characteristic of the resistance card (100 Ohms/square, in this example) can be adjusted to minimize radiation in the nadir direction or otherwise adjust elevation angle pattern characteristics as suitable for particular applications. In achieving these results, performance of the illustrated configuration has been determined to be significantly superior to performance with a metal/conductive serration configuration (no resistance card and thereby a zero Ohms/square characteristic).

In the described configuration, a low cylindrical structure 60 is attached (e.g., conductively) to the outer edge of a ground plane 50, with the absorber configuration 70 extending above the wall structure. In this example a hexagonal cylindrical form was used, as discussed. In other embodiments, a circular or other cylindrical form may be employed, so that for example the outer edge of the ground plane would form a circle and wall structure 60 would follow the form of a section of a circular cylinder, as would absorber configuration 70. Also, for particular embodiments resistance card having other resistance characteristics or other suitable materials may be utilized. The serrations of an absorber configuration may have single or multiple peaks of rounded or other shape, and the valley transitions may be rounded, located some distance above the upper edge of the cylindrical structure 60, or otherwise be configured, as determined by skilled persons implementing the invention for particular applications. As used in connection with the invention, "serrated" is defined as covering the absorber configurations shown and discussed, and as otherwise consistent with the usual dictionary definition regarding having a saw-toothed edge or margin notched with tooth-like projections. Each such serration may, for example, nominally have the form of an equilateral or isosceles triangle. As used herein, "nominally" is defined as within plus or minus 20 percent of a stated value, characteristic or relationship.

FIG. 6 is a computer generated elevation radiation pattern for a FIG. 3 type antenna, showing gain v. elevation angle data. As shown, radiation in the nadir direction is minimized, with highest gain above 55° elevation to zenith as desired for this configuration of the antenna.

FIG. 7 is a similar antenna pattern for the FIG. 3 antenna, showing power level v. elevation angle in dB relative to peak power, with a 0.5 dB/degree cutoff at the horizon. As shown, a high up/down ratio, expressed in dB, of zenith power to nadir power exceeding 30 dB is achieved for a 60° conical pattern extending upward.

A prior form of antenna (i.e., sometimes called a choke-ring antenna) provides reduced radiation in the nadir direction by inclusion of a series of conventional type choke rings arranged concentrically out from a radiating element configuration. Computer analysis of antennas pursuant to the present invention shows improved performance (e.g., higher up/down ratio and other characteristics) as compared to such a choke-ring antenna.

Antennas as shown and described herein can be configured by skilled persons as appropriate for specific applications. Such antennas can provide the benefits of improved performance, small size, superior performance with small volume, low material and production cost, long life and high reliability for DGPS and other applications. While there have been described the currently preferred embodiments of the invention, those skilled in the art will recognize that other and further modifications may be made without departing from the invention and it is intended to claim all modifications and variations as fall within the scope of the invention.

What is claimed is:

1. An antenna, including a progressive-phase-omnidirectional excitation network and an absorber configuration, comprising:

first, second, third and fourth dipoles successively spaced around a vertical axis;

a signal port;

a progressive-phase-omnidirectional (PPO) excitation network, coupled between the signal port and the four dipoles, including (a) a first quadrature coupler coupled to the signal port and coupled between the first and second dipoles to provide first dipole excitation of a first phase and to provide second dipole excitation of a quadrature phase, and (b) a second quadrature coupler coupled to the signal port and coupled between the third and fourth dipoles to provide third dipole excitation of a phase differing by 180 degrees from said first phase and to provide fourth dipole excitation of a quadrature phase relative to the third dipole;

a ground plane section with a reflective surface positioned below the four dipoles;

a cylindrical structure, having a reflective surface, coupled to the ground plane section and extending around the four dipoles;

an absorber configuration having a serrated upper-edge portion extending around the four dipoles above the cylindrical structure and having radiation absorption properties.

2. An antenna as in claim 1, wherein the absorber configuration comprises a plurality of nominally triangular portions of radiation absorbing material extending above the cylindrical structure.

3. An antenna as in claim 2, wherein the radiation absorbing material comprises portions of resistance card stock having a nominal resistance of 100 Ohms per square.

4. An antenna as in claim 1, wherein the cylindrical structure has the form of an octagonal cylinder.

5. An antenna as in claim 4, wherein the absorber configuration comprises eight sections of radiation absorbing material, each having a nominally triangular upper edge portion and each section fixed to one side of the cylindrical structure.

6. An antenna as in claim 1, wherein the vertical position of the upper edge of the cylindrical structure nominally coincides with the horizontal centerline of the four dipoles.

7. An antenna as in claim 1, wherein the upper edge of the cylindrical structure is at a distance above the ground plane section of nominally one-quarter wavelength, at a frequency within an operating frequency band of the antenna.

8. An antenna as in claim 1, arranged to provide a nominally conical antenna pattern extending upward.

9. An antenna, with reduced low-angle reception, comprising:

first, second, third and fourth dipoles successively spaced around a vertical axis and arranged to provide an omnidirectional antenna pattern;

a ground plane section with a reflective surface positioned below the four dipoles;

a cylindrical structure, having a reflective surface, coupled to the ground plane section and extending around the four dipoles;

an absorber configuration having a serrated upper edge portion extending above the cylindrical structure and having radiation absorption properties.

10. An antenna as in claim 9, wherein the absorber configuration comprises a plurality of nominally triangular portions of radiation absorbing material extending above the cylindrical structure.

11. An antenna as in claim 10, wherein the radiation absorbing material comprises portions of resistance card stock having a nominal resistance of 100 Ohms per square.

12. An antenna as in claim 9, wherein the cylindrical structure has the form of an octagonal cylinder.

13. An antenna as in claim 12, wherein the absorber configuration comprises eight sections of radiation absorbing material, each having a nominally triangular upper edge portion and each section fixed to one side of the cylindrical structure.

14. An antenna as in claim 9, wherein the vertical position of the upper edge of the cylindrical structure nominally coincides with the horizontal centerline of the four dipoles.

15. An antenna as in claim 9, arranged to provide a nominally conical antenna pattern extending upward.

16. An antenna, with reduced low-angle reception, comprising:

a plurality of antenna elements positioned around a vertical axis and arranged to provide an omnidirectional antenna pattern;

a ground plane section with a reflective surface positioned below the antenna elements;

a cylindrical structure, having a reflective surface, coupled to the ground plane section and extending around the four dipoles;

an absorber configuration extending around the antenna elements above the cylindrical structure and having radiation absorption properties.

17. An antenna as in claim 16, wherein the absorber configuration includes a serrated upper edge portion.

18. An antenna as in claim 16, wherein the absorber configuration comprises radiation absorbing material with a selected resistance characteristic.

19. An antenna as in claim 16, wherein the vertical position of the upper edge of the cylindrical structure nominally coincides with the horizontal centerline of the antenna elements.

20. An antenna as in claim 16, arranged to provide a nominally conical antenna pattern extending upward.

* * * * *